US007891200B2

(12) United States Patent
Saba et al.

(10) Patent No.: US 7,891,200 B2
(45) Date of Patent: Feb. 22, 2011

(54) VENDING MACHINE IMPROVEMENT

(75) Inventors: Michel Saba, Carmel, NY (US); Emad Jafa, Brewster, NY (US); Daniel F. Joslin, Sartell, MN (US)

(73) Assignee: PepsiCo, Inc., Purchase, NY (US)

( * ) Notice: Subject to any disclaimer, the term of this patent is extended or adjusted under 35 U.S.C. 154(b) by 415 days.

(21) Appl. No.: 11/954,963

(22) Filed: Dec. 12, 2007

(65) Prior Publication Data

US 2009/0152287 A1 Jun. 18, 2009

(51) Int. Cl.
*F25D 17/06* (2006.01)

(52) U.S. Cl. ..... 62/89; 626/186; 626/228.1; 626/389

(58) Field of Classification Search ..... 62/186, 62/228.1, 389–390, 246–256, 507, 89
See application file for complete search history.

(56) References Cited

U.S. PATENT DOCUMENTS

| | | | | |
|---|---|---|---|---|
| 2,130,093 | A * | 9/1938 | Kettering | 62/176.6 |
| 2,388,800 | A * | 11/1945 | Pearce | 62/163 |
| 2,677,241 | A * | 5/1954 | Schmock | 62/180 |
| 3,034,314 | A * | 5/1962 | Canter | 62/180 |
| 3,127,754 | A * | 4/1964 | Mobarry | 62/158 |
| 3,877,243 | A | 4/1975 | Kramer | |
| 4,094,166 | A | 6/1978 | Jerles | |
| 4,467,617 | A | 8/1984 | Morgan, Jr. et al. | |
| 4,485,633 | A | 12/1984 | King et al. | |
| 4,688,393 | A | 8/1987 | Linstromberg et al. | |
| 2005/0144966 | A1 * | 7/2005 | Upton et al. | 62/246 |
| 2005/0160747 | A1 * | 7/2005 | Kaga et al. | 62/228.1 |
| 2005/0177282 | A1 | 8/2005 | Mason, II | |

FOREIGN PATENT DOCUMENTS

| | | |
|---|---|---|
| EP | 0151496 | 8/1985 |
| WO | 2008039819 A2 | 4/2008 |

OTHER PUBLICATIONS

European Patent Application No. 08075870.9 Extended European Search Report dated Mar. 24, 2010.
China Patent Application No. 2008101754195.5 Office Action dated May 14, 2010.
EP 08075870.9 Office Action dated Nov. 30, 2010.
CN 200810175419.5 Office Action dated Nov. 16, 2010.

* cited by examiner

*Primary Examiner*—William E Tapolcai
(74) *Attorney, Agent, or Firm*—Banner & Witcoff Ltd.

(57) ABSTRACT

A vending machine system includes a control module for controlling a cooling system. The cooling system, which includes an evaporator, may omit a heating element for defrosting the evaporator. In operation, the control module cycles an evaporator fan in conjunction with a compressor based on a required set temperature to help keep products within a specified range. In an embodiment, the evaporator fan is turned on and off at substantially the same time as the compressor is turned on and off. In another embodiment, there is a predetermined delay after the compressor is turned on and off before the evaporator is respectively turned on and off. Other variations are contemplated.

21 Claims, 6 Drawing Sheets

VENDING MACHINE IMPROVEMENT

BACKGROUND OF THE INVENTION

1. Field of the Invention

The present invention relates to the field of vending systems, more particularly to the field of vending machines configured to provide cooled items.

2. Description of Related Art

Vending machines allow a consumer to purchase a relatively inexpensive item throughout the day without the costly need for an individual to stand there and conduct the transaction on behalf of the person selling the item. Thus, vending machines have been successful because they have the ability to provide enhanced convenience to consumers and vending machines allow transactions to be conducted that would otherwise not be possible due to transaction costs. Vending machines exist in a variety of configurations for a variety of products. One common feature, however, is that for certain products there is a desire that the product be cooled when delivered to the consumer. For example, a cold bottle of water is generally considered more desirable to consumers than a hot bottle of water, especially during hot summer months.

While it is well accepted that cooling enhances the desirability of certain products, one issue that exists is how to provide the appropriately cooled product at a reasonable cost. A vending machine placed in a warehouse, for example, would experience significant heat load during summer months. This typically translates into increased operating costs and greater energy requirements at a time when energy usage is already near a peak. Therefore, it would be beneficial to operator of the vending machine, as well as to the public at large, to reduce the energy required to maintain products stored within the vending machine at the appropriate temperature.

Naturally, improvements in insulation and component design can provide a certain level of increased efficiency; however, space constraints, material costs and material properties limit the amount of increased efficiency possible by such means. Furthermore, as the insulation and component efficiency is improved, additional improvements provide decreasing rates of return. Therefore, other methods of improving the efficiency of a vending system would be appreciated

BRIEF SUMMARY OF THE INVENTION

A vending machine system and a method of operation are disclosed. The vending machine system includes a chamber. The chamber is cooled with a refrigeration system that includes an evaporator and an evaporator fan positioned in the chamber and a compressor and condenser positioned outside the chamber. The refrigeration system may omit a heating element for defrosting the evaporator. A control module is provided to cycle the evaporator fan in conjunction with the compressor and metering refrigerant device. For control configuration, the control module controls the compressor start and stop based on required set temperature to keep the chamber and the products within specification required. In an embodiment, the compressor and evaporator fan are turned on and off at substantially the same time. The evaporator fan may run under its own kinetic energy for a short period after the compressor shut off based on the sensor signal. The sensor that sends the signals to the controller is located on evaporator surface to capture accurate required cooling load. For direct connection, the evaporator fan is connected directly to the compressor to run with it and stop simultaneously. In control module configuration and direct configuration, a sensor located on the evaporator may send the signal to start of stop the compressor based on required temperature.

This summary is provided to introduce a selection of concepts in a simplified form that are further described below in the Detailed Description. The Summary is not intended to identify key features or essential features of the claimed subject matter, nor is it intended to be used to limit the scope of the claimed subject matter.

BRIEF DESCRIPTION OF THE DRAWINGS

The present invention is illustrated by way of example and not limited in the accompanying figures in which like reference numerals indicate similar elements and in which.

DETAILED DESCRIPTION OF THE INVENTION

Figure 1:
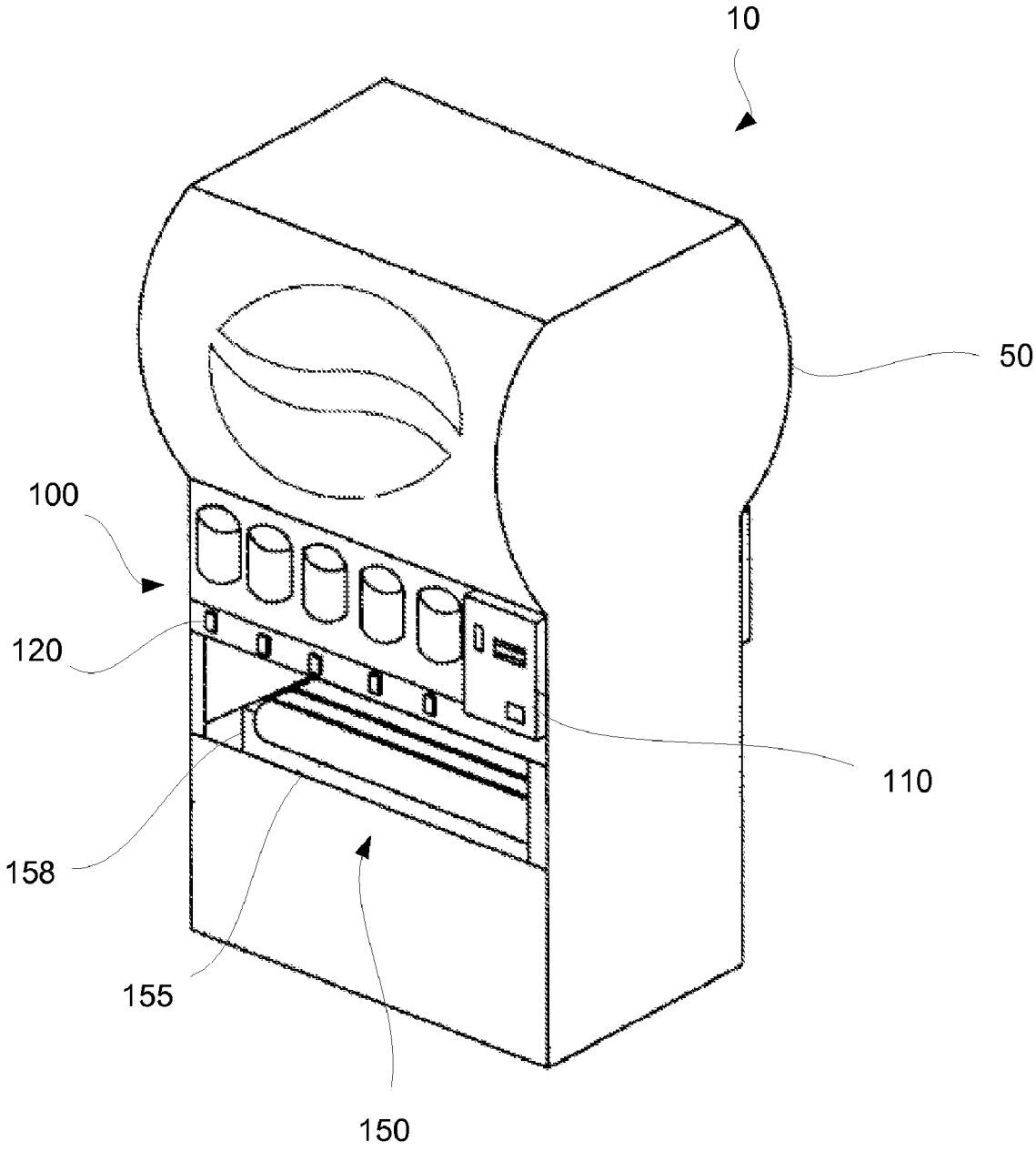
FIG. 1 illustrates an isometric view of an embodiment of a vending machine.

Vending machines provide a beneficial service because of the flexibility in placement and the absence of a need to have a person present in order to complete a transaction. Thus, vending machines provide a useful economic benefit because of the efficiency in the transaction, which results in lower costs for the consumer. For example, a beverage vending machine allows a user to quickly make payment and upon receipt of a user selection, provide a cooled beverage. This flexibility has a potential side-effect. The ability to place a vending machine in a location that maximizes customer convenience has the potential to subject the vending machine to significant heat loads. The heat load in turn requires that significant energy be exerted in order for items stored in the vending machine, such as filled beverage containers, to be kept at a desired temperature. Therefore, it is desirable to reduce the energy required while still providing the flexible and convent placement.

FIGS. 1-4 represent an embodiment of a filled beverage container vending system.

Such systems are well suited to provide a consumer with, for example but without limitation, a carbonated beverage or a nutritional supplement. Furthermore, such vending system can be configured to work with a variety of different types of beverage containers, such as plastic bottles and aluminum cans. It should be noted, however, that vending systems designed to distribute items other than filled beverages container may also take advantage of various aspects disclosed herein, therefore this disclosure is not intended to be limiting in this respect.

As depicted, a vending system 10 includes a housing 50 on which a user interface 100 and a beverage delivery module 150 are provided. The user interface 100 includes a payment module 110 and a plurality of selection elements 122 on a selector module 120 so that a user may make a payment and then select the beverage of choice. A distribution module 170 delivers the selected filled beverage container to the beverage delivery module 150, which includes an opening 155 that allows the user to access the filled beverage container as it rests in a holding portion 158. A door, not shown, may also be included to prevent dust and such from entering the opening 155 in between use.

To control delivery of the filled beverage container, a control module 200 is provided. Pressing the selection element 122 prior to providing payment will tend to have no effect (unless the vending machine has been set to not require payment and the user is pre-authorized to make a selection). However, if the user first provides either currency or some form of electronic payment to the payment module 110, the user may then may a selection and receive the filled beverage container. Once payment is determined to have been made (this may be done entirely by the payment module 110 or via a combination of processing steps performed by the payment module 110 and the control module 200), the control module 200 accepts the next user selection as being authorized and provides an appropriate corresponding signal to the distribution module 170 so that the desired filled beverage container may be delivered to the beverage delivery module 150.

Figure 2:
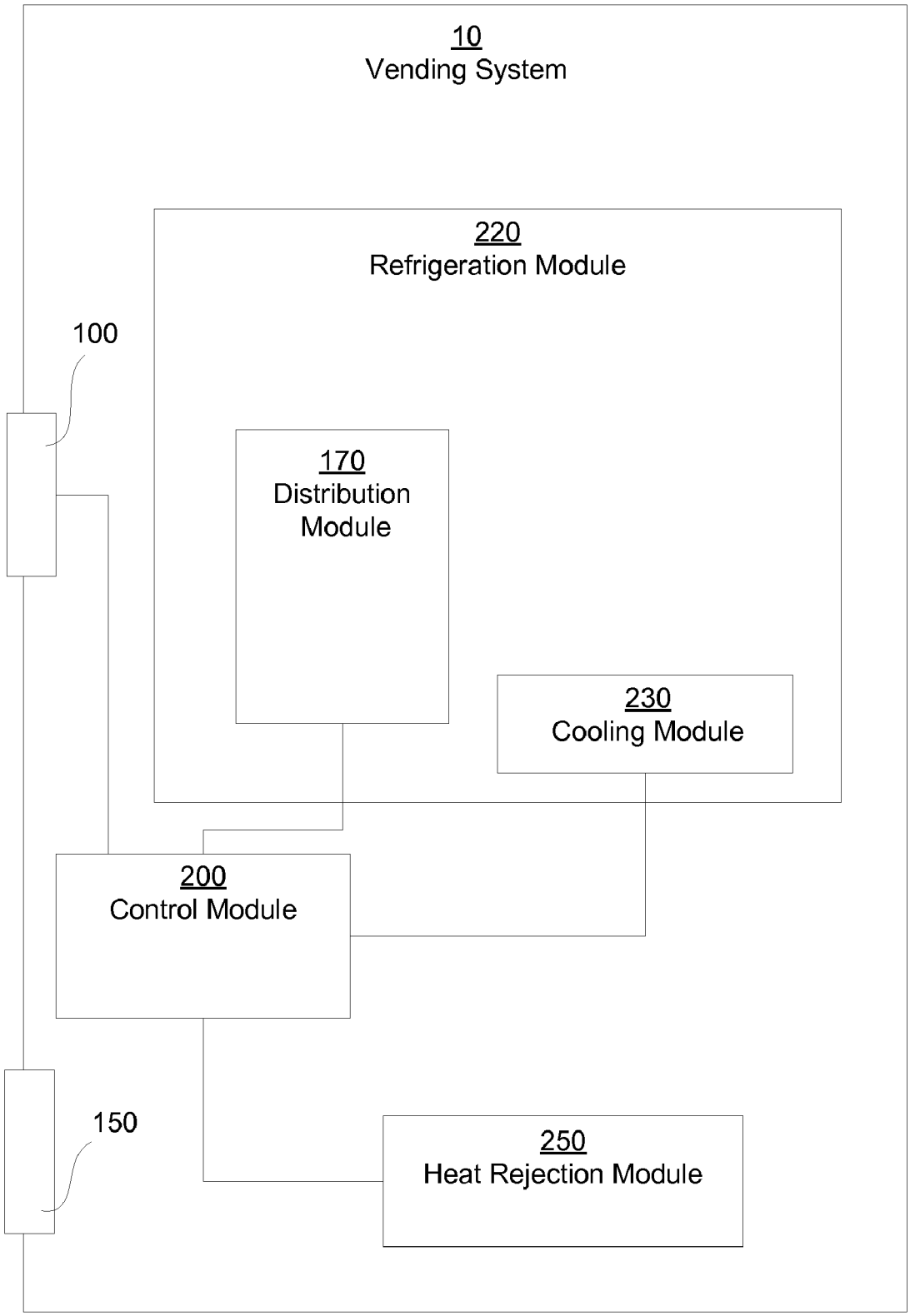
FIG. 2 illustrates a schematic view of an embodiment of a vending machine system.

The control module 200 includes a processing module 202 and a memory module 204. The processing module 202 may be a convention microprocessor and may include a time keeping element (such as a real time clock)—not shown. The memory module may be a combination of different types of memory and may be read-only, programmable, or a combination of both. It should be noted that while these features are shown separately, they may be incorporated into a single module that includes both processing capabilities and memory. In an alternative embodiment, the various features may be otherwise split into a number of systems, thus the depicted embodiment in FIG. 2 are directed to the logical structure rather than representing a physical design. Also shown is an optional communication module 206. In an embodiment, statistics regarding use of the vending system 10 can be stored in the memory module 204 and provided to an authorized user on an appropriate basis. As can be appreciated, the optional communication module 206 may allow for wireless communication or may be a wired connection, depending on system requirements.

Figure 3:
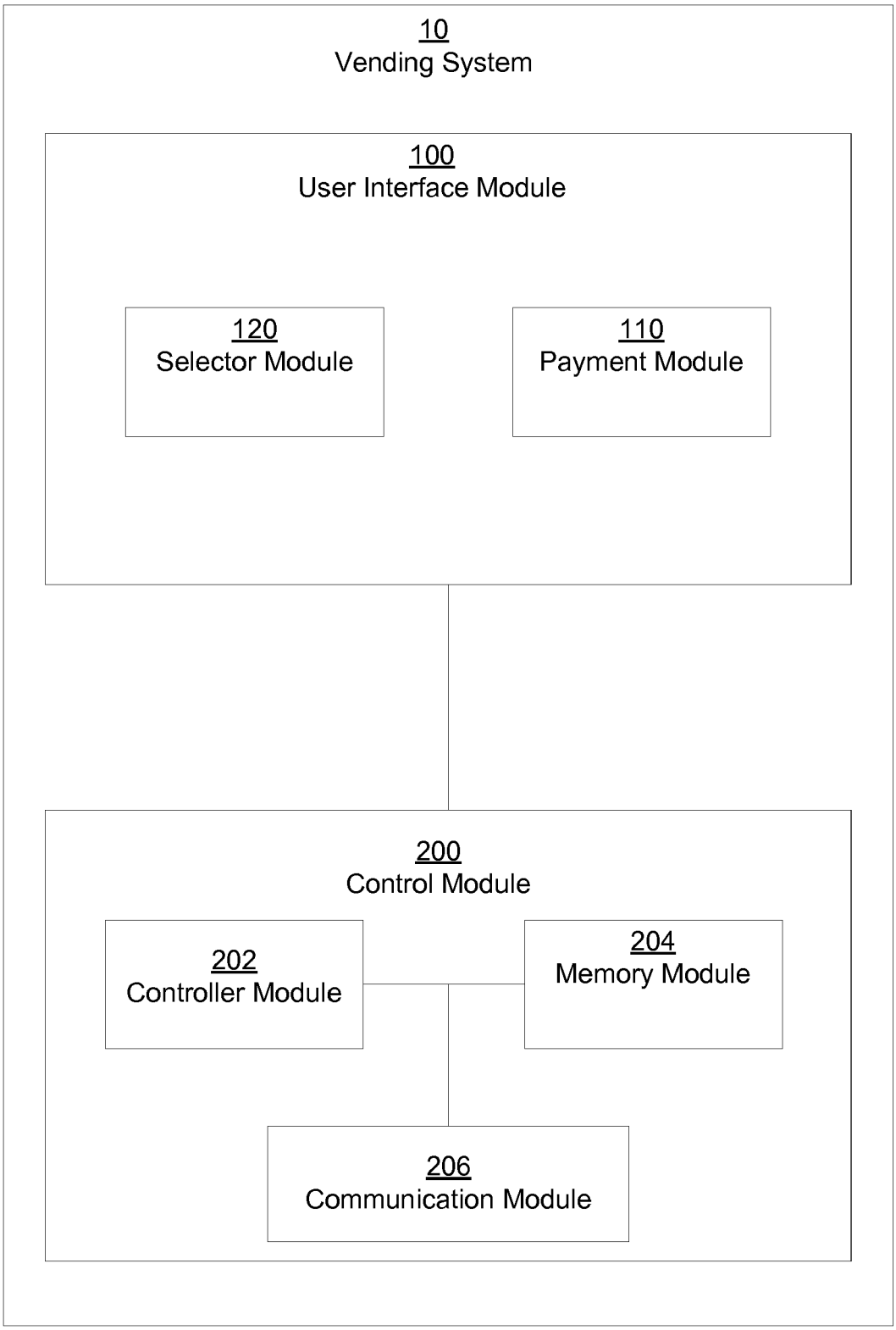
FIG. 3 illustrates a partial schematic view of an embodiment of a control system for a vending machine.

In order to keep the filled beverage containers at the desired temperature, at least a portion of the filled beverage containers that are being stored in the vending machine are placed in a refrigeration module 220. The distribution module 170 is configured to select a filled beverage container from the refrigeration module 220 and deliver it to the beverage delivery module 150 in a desired manner. In this regard it should be noted that a large number of variations exist in how filled beverage containers are moved from a first location to a second location, thus this disclosure is not intended to be limiting in this respect. Furthermore, the depicted schematic representations depicted in FIGS. 3 and 4 are merely representative of exemplary embodiments and variations in the location of various components with respect to other components are contemplated.

To keep the filled beverage containers cool, a cooling system 230 is depicted positioned within the refrigeration module 220. The cooling module 230 removes heat from the refrigeration module 220 and distributes the heat to the heat rejection module 250. The heat rejection module 250 then directs the heat away from the vending system 10.

Figure 4:
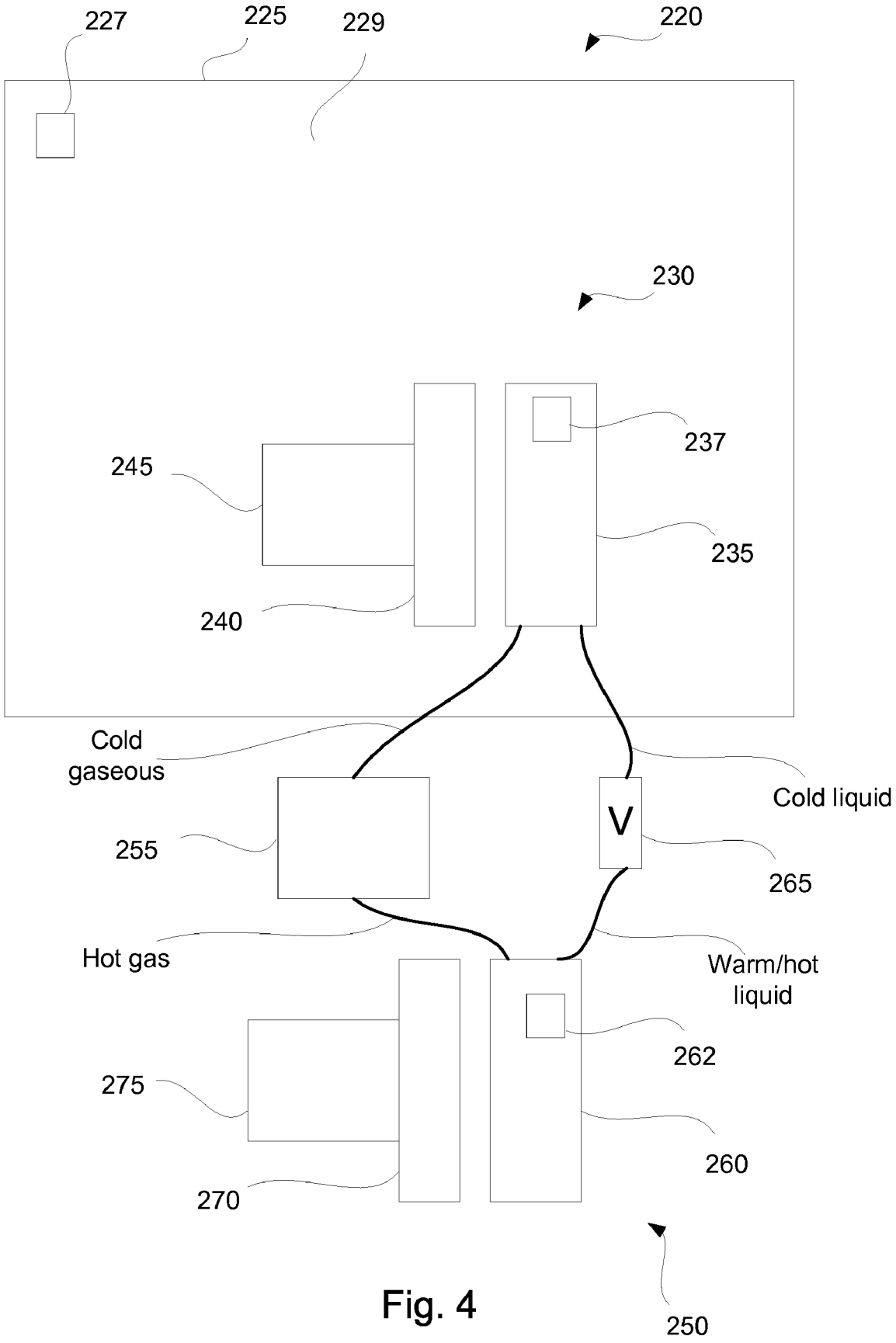
FIG. 4 illustrates a schematic view of an embodiment of a cooling system for a vending machine.

While numerous variations are possible, FIG. 4 illustrates a schematic layout of various components of an embodiment of a cooling module 220 and a heat rejection module 250. The refrigeration module 220 includes a chamber 225 and may include a temperature sensor 227 positioned in an interior 229 of the chamber 225. In an embodiment, the temperature sensor 227 may provide a signal that corresponds to the interior temperature of the chamber 225.

As depicted, the cooling module 230 is positioned within the chamber 225 and includes an evaporator (or first heat exchanger) 235, an optional sensor 237 that may be positioned on or adjacent the evaporator 235, an evaporator fan 240 and a fan motor 245 that drives the evaporator fan 240. The sensor 237 may be any type of sensor that may be used to determine whether the evaporator is freezing up, such as a conventional temperature sensor. It should be noted, however, that a heating element for defrosting the evaporator 235 is not shown. This is because in at least some embodiments the heating element is not included so as to reduce the system costs. More will be said regarding this omission below.

In operation, a cold liquid (typically formed of some type of conventional refrigerant) is directed into the evaporator. The evaporator fan 240 directs air toward and across the evaporator 235 and heat from the air is absorbed and used to convert the liquid in the evaporator into a gas. This phase change absorbs a substantial amount of heat and thus acts to cool the air flowing over the evaporator. Thus, the effect is that the evaporator fan 240 causes cold air to be directed away from the evaporator 235 and into the chamber 225 where it keeps the interior at the desired temperature. Depending on the type of refrigeration system, the phase of the refrigerant exiting the evaporator 235 will be mostly or entirely gaseous.

As can be appreciated, this allows heat to be removed from the chamber 225, thus acting to keep the beverages positioned within the chamber 225 at the desired cool temperature. In order for the cooling system to be effective, however, the heat must then be rejected from the system so that additional heat from the chamber can be absorbed.

To rejection the heat, the heat rejection module 250 is provided. Cold gaseous refrigerant is directed toward a compressor 255. The compressor 255 compresses the refrigerant into a high pressure gas, increasing its temperature in the process, and then directs the hot gas toward a condenser (or second heat exchanger) 260. The condenser 260 allows the high temperature gas to emit heat into the atmosphere (e.g. outside of the system) and condenses the refrigerant into a liquid in the process. This warm/hot high pressure liquid is then directed toward an expansion valve 265. The drop in pressure causes the liquid to cool. The cold liquid then enters the evaporator 235 and the process is repeated.

As shown, the heat rejection module 250 includes an optional fan 270 that is driven by a motor 275. As can be appreciated, the use of a fan 270 allows for a reduction in the size of the condenser 260, which would otherwise need to be larger to allow for sufficient heat to radiate if only passive heat rejection techniques were used. In addition, the use of a fan also aids in directing hot air out of and away from the housing 50, which is particularly helpful if the condenser 260 is contained within the housing 50. A sensor 262 may be included on the condenser to detect a desirable parameter of operation, such as the temperature of the condenser 260.

Figure 5:
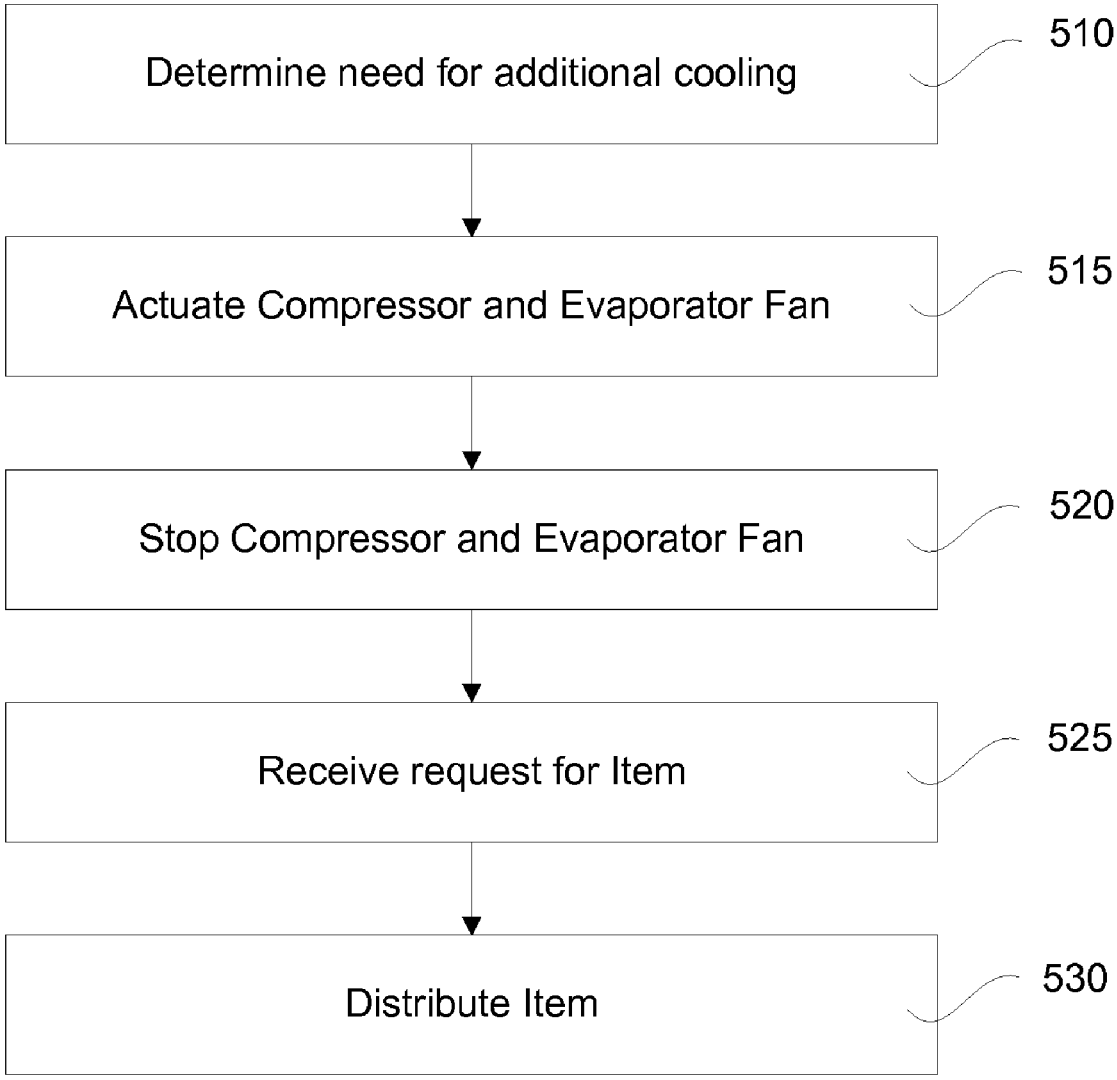
FIG. 5 illustrates a method of providing a cooled beverage in accordance with one or more aspects of the present invention.

FIG. 5 illustrates a method that may be used to provide a cooled beverage to a consumer. First in step 510, a determination is made that additional cooling is required in the chamber 225. As can be appreciated, this may be based on a signal received from the sensor 227 positioned within chamber 225. Alternatively, some other method of determining the need for cooling can be implemented, such as using a time based algorithm in combination with external temperatures or using a sensor positioned outside the chamber but in close proximity thereto.

Then in step 515, the compressor 255 and evaporator fan 240 are switched on, which is the first part of a cycle. Thus, as used herein, cycling refers to actuating or turning the compressor and/or evaporator fan on and then turning them off. Thus, a cycling of a component will involve switching the component to an on-state and then switching the component to an off-state. It should be noted that an on-state may include some intermittent stops and starts but generally is continuously on for a period of time. Therefore, in step 515, both the compressor 255 and the evaporator fan 240 are switched to an on state.

In an embodiment, the switch between on and off states will be substantially simultaneous for both the compressor 255 and the evaporator fan 240. In an alternative embodiment, the evaporator fan 240 will have a predetermined delay before turning on. In another embodiment, the evaporator fan 240 will turn on after the compressor 255 turns on but the actual timing of the switch to the on-state the evaporator fan 240 will be tied to a temperature sensor (or some other type of sensor) that indicates the temperature of the evaporator 235 is such that the state change should take place. For example, in an embodiment the evaporator fan 240 would delay turning on until the evaporator 235 was colder than the temperature of the chamber interior 229.

Next in step 520, the compressor 255 and evaporator fan 240 are switched off, which is the second part of the cycle. In an embodiment, the turning off of the evaporator fan 240 will be substantially simultaneous with the turning off of the compressor 255. In an alternative embodiment, the evaporator fan 240 may be turned off after the compressor 255 is turned off. The delay may be a predetermined delay or may be based on a signal received from a sensor. For example, the evaporator fan 240 may be shut off once the temperature of the evaporator 235 was close or equal to the temperature of the chamber interior 229.

Thus, the cycling of the evaporator fan 240 is in conjunction with (e.g. based directly on) cycling of the compressor 255. As can be appreciated, this approach minimizes energy consumption because the evaporator fan 240 is not left running constantly. In this regard, the absence of a heating element to defrost the evaporator 235 is significant for certain embodiments because it is believed that in general, attempts to cycle the evaporator fan 240 with the compressor 255 have required the use of a heating element to defrost the evaporator 235. Here, it has been discovered that the temperature of the system allows the system to function adequately without the need for defrosting the evaporator 235. In addition, any needed defrost can be addressed by cycling the evaporator fan 240 periodically. Thus, minimal heat is added to the system and the energy required to continuously run the evaporator fan 240 is avoided, which has the benefit of providing significant efficiency gains. For example, depending on the configuration of the vending system 10 selected, reductions in energy consumption in the range of about 30 percent are possible.

Next in step 525, a request for an item is received. Typically this will involve the user providing payment, either directly with currency of some type or electronically via a credit card or some other mechanism that is associated with an account belonging to the user. As can be appreciated, the user interface 110 may include a screen that indicates payment has been received and may further provide an indication to the user that the user should make a selection. Once the user provides payment, the user will then make a selection. Typically the selection process will involve the user actuating a selection element 122, such as a button, associated with a graphic displayed on the housing.

Then in step 530, the item is distributed. As noted above, variations exist in how the delivery of the filled beverage container, in particular, may be accomplished. For example, gravity based distribution systems and conveyer based distribution systems are exemplary methods of distribution for filled beverage containers. However, if items other than filled beverage containers are being distributed, the distribution system should be configured appropriately. Thus, the technique(s) used to transport an item from the refrigerated chamber to a location where the user can take the item is not critical and this disclosure is not intended to be limiting in this regard.

Figure 6:
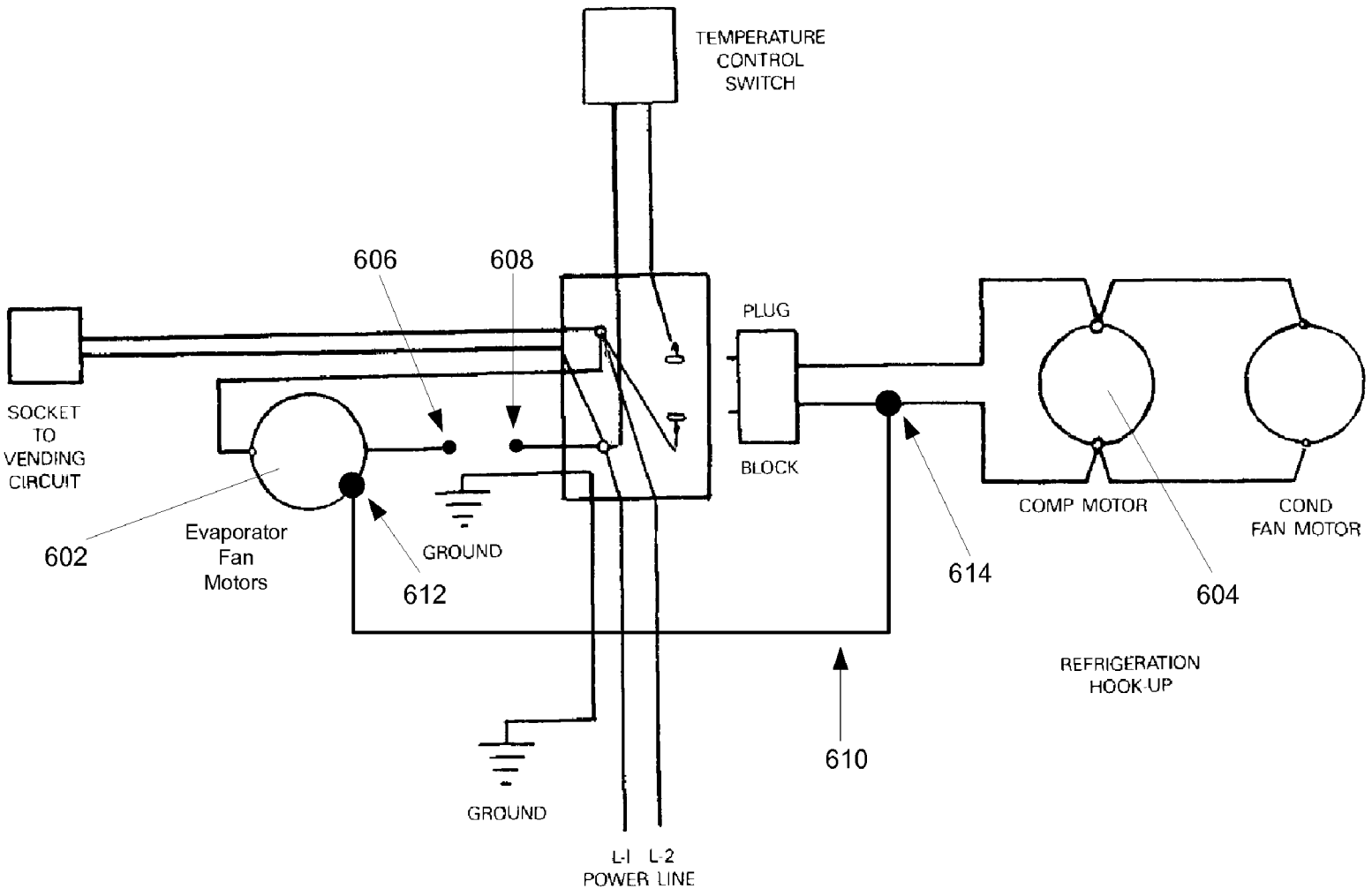
FIG. 6 illustrates a vending machine wiring diagram in which an evaporator fan is run in synchronism with a compressor, in accordance with an embodiment of the invention.

FIG. 6 illustrates a vending machine wiring diagram in which an evaporator fan 602 is run in synchronism with a compressor 604. Prior art systems include a connection between points 606 and 608 and do not include a conductor 610 between points 612 and 614. With prior art systems, the control of evaporator fan 602 is independent of the control of compressor 604. Removing a connection between points 606 and 608 and providing conductor 610 between points 612 and 614 results in power being applied to evaporator fan 602 and compressor 604 at the same time. Running evaporator fan 602 in synchronism with compressor 604 can result in energy savings without building freeze up on the evaporator. In certain embodiments energy may also be saved without warming the cooling chamber and products within the cooling chamber and remaining within product specifications.

The present invention has been described in terms of preferred and exemplary embodiments thereof. Numerous other embodiments, modifications and variations within the scope and spirit of the appended claims will occur to persons of ordinary skill in the art from a review of this disclosure.

We claim:

1. A method of providing a cooled beverage to a consumer, comprising:

(a) determining an interior of a chamber requires cooling;

(b) comparing a temperature of the interior of the chamber and a temperature of an evaporator;

(c) cycling an evaporator fan in conjunction with cycling of a compressor based on the comparison, the cycling comprising switching to an on-state and then switching to an off-state;

(d) receiving an authorized selection of an item contained in the chamber; and (e) automatically providing the selected item in a cool state.

2. The method of claim 1, wherein the cycling of the evaporator fan comprises switching to a fan-on state and then switching to a fan-off state and the cycling of the compressor comprises switching to a compressor-on state and then switching to a compressor-off state.

3. The method of claim 2, wherein the fan-off state begins when the temperature of the evaporator is near to the temperature of the interior of the chamber.

4. The method of claim 2, wherein the fan-off state begins after the compressor-off state begins.

5. The method of claim 4, wherein the fan-off state begins in response to a signal received from a temperature sensor.

6. The method of claim 1, wherein the cycling of the evaporator fan comprises switching to a fan-on state and then switching to a fan-off state and the cycling of the compressor comprises switching to a compressor-on state and then switching to a compressor-off state, wherein the fan-on state begins after the compressor-on state begins and the fan-off state begins after the compressor-off state begins.

7. The method of claim 1, wherein the receiving in (d) comprises:

(i) determining that payment has been made; and (ii) in response to the determining that a payment has been made, accepting a user input associated with the item selection.

8. The method of claim 1, wherein the item is a beverage container filled with a carbonated beverage.

9. The method of claim 1, further comprising:

(e) cycling the evaporator fan for an interval of time after a predetermined period of time, the cycling preventing the build-up of ice on the evaporator.

10. A beverage vending system, comprising:

a housing;

a user interface mounted to the housing, the user interface configured to receive a user authorized selection of a beverage;

a beverage delivery module on the housing, the beverage delivery module configured to provide access to a distributed beverage;

a refrigeration module positioned at least partially in the housing and configured to hold a set of beverages in a cooled state, the refrigeration module including a first fan and an evaporator, the first fan configured to direct air across the evaporator;

a distribution module configured to deliver a beverage from the refrigeration module to the beverage delivery module in response to an authorized user selection;

a heat rejection module including a compressor and a condenser in fluid communication with the evaporator; and a control module to compare a temperature of a chamber interior of the refrigeration module and a temperature of the evaporator and to cycle the first fan in conjunction with cycling of the compressor based on the comparison.

11. The system of claim 10, wherein the refrigeration module does not include a heating element configured to warm the evaporator.

12. The system of claim 10, wherein the cycling includes an on-state and an off-state.

13. The system of claim 12, wherein the cycling of the first fan to the off-state begins when the temperature of the evaporator is near to the temperature of the chamber interior.

14. The system of claim 12, wherein the control module is configured to cause the off-state of the first fan to begin after the off-state of the compressor begins.

15. The system of claim 13, wherein a first fan off-state begins a predetermined period of time after an off-state of the compressor.

16. The system of claim 13, wherein a first fan off-state begins in response to a signal received from a sensor.

17. The system of claim 10, wherein the heat rejection module further comprises a second fan configured to direct air across the condenser.

18. The system of claim 10, wherein the cycling includes an on-state and an off-state and the control module is configured to cause an on-state of the first fan to begin after an on-state of the compressor.

19. A heat exchange system for a vending machine, comprising:

a temperature sensor;

an evaporator configured to be positioned in a chamber desired to be cooled, the system not including a heating element for defrosting the evaporator;

a fan configured to direct air toward the evaporator;

a compressor in fluid communication with the evaporator;

a condenser in fluid communication with the evaporator and the compressor;

an expansion valve positioned between and in fluid communication with the condenser and the evaporator; and a control module to compare a temperature of the interior of the chamber and a temperature of the evaporator, to cycle the compressor in response to a signal provided by the temperature sensor, and to cycle the fan in response to cycling of the compressor based on the comparison.

20. The system of claim 19, wherein the cycling of the fan to an off-state begins when the temperature of the evaporator is near to the temperature of the interior of the chamber.

21. The system of claim 19, wherein the control module is configured to stop the fan a predetermined period of time after the compressor is stopped.

* * * * *